US010923057B2

(12) United States Patent
Fu et al.

(10) Patent No.: US 10,923,057 B2
(45) Date of Patent: Feb. 16, 2021

(54) PIXEL CIRCUIT AND DISPLAY DEVICE

(71) Applicants: BOE Technology Group Co., Ltd., Beijing (CN); Ordos Yuansheng Optoelectronics Co., Ltd., Ordos (CN)

(72) Inventors: Yishan Fu, Beijing (CN); Jun Fan, Beijing (CN); Fuqiang Li, Beijing (CN); Jiguo Wang, Beijing (CN)

(73) Assignees: BOE Technology Group Co., Ltd., Beijing (CN); Ordos Yuansheng Optoelectronics Co., Ltd., Inner Mongolia (CN)

( * ) Notice: Subject to any disclaimer, the term of this patent is extended or adjusted under 35 U.S.C. 154(b) by 103 days.

(21) Appl. No.: 16/170,395

(22) Filed: Oct. 25, 2018

(65) Prior Publication Data

US 2019/0180706 A1 Jun. 13, 2019

(30) Foreign Application Priority Data

Dec. 13, 2017 (CN) ..... 2017 1 1329200

(51) Int. Cl.
*G09G 3/36* (2006.01)

(52) U.S. Cl.
CPC ... *G09G 3/3648* (2013.01); *G09G 2300/0871* (2013.01); *G09G 2310/0264* (2013.01)

(58) Field of Classification Search
CPC ..... G09G 3/3648; G09G 2310/0264; G09G 2300/0871; G09G 3/3614; G09G 3/3677; G09G 3/3688
See application file for complete search history.

(56) References Cited

U.S. PATENT DOCUMENTS 4,953,133 A * 8/1990 Kashimura ..... G11C 7/00 365/230.06
5,461,593 A * 10/1995 Kim ..... G11C 11/40 365/230.06

(Continued)

FOREIGN PATENT DOCUMENTS

CN 1379384 A 11/2002
CN 1820300 A 8/2006

(Continued)

OTHER PUBLICATIONS

First office action of Chinese application No. 201711329200.1 dated Dec. 3, 2019.

*Primary Examiner* — Temesghen Ghebretinsae
*Assistant Examiner* — Karin Kiyabu
(74) *Attorney, Agent, or Firm* — Fay Sharpe LLP

(57) ABSTRACT

A pixel circuit and a display device are provided. The pixel circuit includes: a first inverter circuit having an input terminal connected to a first node and an output terminal connected to a second node; a second inverter circuit having an input terminal connected to the second node and an output terminal connected to a third node; a first switching circuit configured to disconnect a connection between the first node and the third node when a first scanning signal is at an active level; and a control circuit configured to control a level of at least one of the first node and the second node according to a level control signal when the first scanning signal is at an active level. Based on this, it can help to avoid the output signal abnormality of the latch inside the pixel and enhance the working stability of the pixel circuit.

20 Claims, 5 Drawing Sheets

(56) References Cited

U.S. PATENT DOCUMENTS

| | | | |
|---|---|---|---|
| 8,400,388 | B2 | 3/2013 | Kim et al. |
| 2002/0153843 | A1 | 10/2002 | Senda et al. |
| 2007/0109282 | A1 | 5/2007 | Kida et al. |
| 2010/0073389 | A1 | 3/2010 | Yasuda et al. |

FOREIGN PATENT DOCUMENTS

| | | | |
|---|---|---|---|
| CN | 1847936 | A | 10/2006 |
| CN | 109389954 | A | 2/2019 |

* cited by examiner

PIXEL CIRCUIT AND DISPLAY DEVICE

This application claims priority to Chinese Patent Application No. 201711329200.1, filed on Dec. 13, 2017 and titled "PIXEL CIRCUIT AND DISPLAY DEVICE", the disclosure of which is hereby incorporated by reference in its entirety.

TECHNICAL FIELD

The present disclosure relates to a pixel circuit and a display device.

BACKGROUND

A traditional active-matrix display device, either in a dynamic-picture display mode or a static-picture display mode, writes data into a pixel through a driver. In this case, during display of a static picture, the driver repeatedly writes the same data into the pixel. In view of this, a memory may be disposed in each pixel, such that during display of the static picture, data memorized by the memories may be written into the pixels to replace of driving by the driver and reduce power loss. To meet the application demands of high-PPI (Pixels Per Inch), low-power-consumption and low-cost of the display device, a latch circuit formed by transistors is disposed usually within the pixel to realize the function of the memory.

SUMMARY

There is provided a pixel circuit and a display device in the present disclosure.

In an aspect, there is provided a pixel circuit in the present disclosure, comprising:

a first inverter circuit having an input terminal connected to a first node and an output terminal connected to a second node;

a second inverter circuit having an input terminal connected to the second node and an output terminal connected to a third node;

a first switching circuit connected respectively to the first node and the third node and configured to disconnect a connection between the first node and the third node when a first scanning signal is at an active level; and a control circuit connected to at least one of the first node and the second node and configured to control a level of at least one of the first node and the second node according to a level control signal when the first scanning signal is at an active level.

In a possible implementation, the pixel circuit further comprises:

a data writing circuit, connected to at least one of the first node and the second node, and configured to determine a data writing mode according to the level of at least one of the first node and the second node and to write a display data signal according to a currently determined data writing mode when the second scanning signal is at an active level.

In a possible implementation, the control circuit and the data writing circuit are both connected to a data line, and the level control signal and the display data signal are provided by the data line.

In a possible implementation, the data writing circuit comprises:

a gating sub-circuit connected to at least one of the first node and the second node and configured to provide a display data signal of one of a to-be-displayed picture and a normally-black picture for a fourth node according to the level of at least one of the first node and the second node; and a scanning sub-circuit connected to the fourth node and configured to provide the display data signal at the fourth node for a pixel electrode when the second scanning signal is at an active level.

In a possible implementation, the scanning sub-circuit comprises a first transistor, a gate of the first transistor is connected to the second scanning signal, one of a source and a drain of the first transistor is connected to the fourth node, and the other one is connected to the pixel electrode.

In a possible implementation, the gating sub-circuit comprises a second transistor and a third transistor;

a gate of the second transistor is connected to the second node, one of a source and a drain of the second transistor is connected to the display data signal of the to-be-displayed picture, and the other one is connected to the fourth node; and a gate of the third transistor is connected to the first node, one of a source and a drain of the third transistor is connected to the display data signal of the normally-black picture, and the other one is connected to the fourth node.

In a possible implementation, the first switching circuit and the control circuit are both connected to a first scanning line which provides the first scanning signal.

In a possible implementation, the first switching circuit comprises a fourth transistor;

a gate of the fourth transistor is connected to the first scanning signal, one of a source and a drain of the fourth transistor is connected to the second node, and the other one is connected to the third node;

wherein the active level of the first scanning signal is within a range of a gate voltage that causes the fourth transistor to operate in a cut-off region.

In a possible implementation, the control circuit comprises a fifth transistor;

a gate of the fifth transistor is connected to the first scanning signal, one of a source and a drain of the fifth transistor is connected to the level control signal, and the other one is connected to the first node;

wherein the active level of the first scanning signal is within a range of a gate voltage that causes the fifth transistor to operate beyond a cut-off region.

In a possible implementation, the first inverter circuit comprises a sixth transistor and a seventh transistor, and the second inverter circuit comprises an eighth transistor and a ninth transistor;

a gate of the sixth transistor is connected to the first node, one of a source and a drain of the sixth transistor is connected to the second node, and the other one is connected to a first level voltage line;

a gate of the seventh transistor is connected to the first node, one of a source and a drain of the seventh transistor is connected to a second level voltage line, and the other one is connected to the second node;

a gate of the eighth transistor is connected to the second node, one of a source and a drain of the eighth transistor is connected to the third node, and the other one is connected to the first level voltage line; and a gate of the ninth transistor is connected to the second node, one of a source and a drain of the ninth transistor is connected to the second level voltage line, and the other one is connected to the third node;

wherein a level on the first level voltage line is within a range of a gate voltage that causes the sixth transistor and the eighth transistor to operate in a cut-off region, a level on the second level voltage line is within a range of a gate voltage that causes the seventh transistor and the ninth transistor to operate in a cut-off region, and the level on the first level voltage line is opposite to the level on the second level voltage line.

In another aspect, there is provided a display device, comprising a plurality of pixel circuits, wherein each pixel circuit comprises:

a first inverter circuit having an input terminal connected to a first node and an output terminal connected to a second node;

a second inverter circuit having an input terminal connected to the second node and an output terminal connected to a third node;

a first switching circuit connected respectively to the first node and the third node and configured to disconnect a connection between the first node and the third node when a first scanning signal is at an active level; and a control circuit connected to at least one of the first node and the second node and configured to control a level of at least one of the first node and the second node according to a level control signal when the first scanning signal is at an active level.

In a possible implementation, the pixel circuit further comprises:

a data writing circuit connected to at least one of the first node and the second node and configured to determine a data writing mode according to the level of at least one of the first node and the second node and to write a display data signal according to a currently determined data writing mode when the second scanning signal is at an active level.

In a possible implementation, the control circuit and the data writing circuit are both connected to a data line, and the level control signal and the display data signal are provided by the data line.

In a possible implementation, the data writing circuit comprises:

a gating sub-circuit connected to at least one of the first node and the second node and configured to provide a display data signal of one of a to-be-displayed picture and a normally-black picture for a fourth node according to the level of at least one of the first node and the second node; and a scanning sub-circuit connected to the fourth node and configured to provide the display data signal at the fourth node for a pixel electrode when the second scanning signal is at an active level.

In a possible implementation, the scanning sub-circuit comprises a first transistor, a gate of the first transistor is connected to the second scanning signal, one of a source and a drain of the first transistor is connected to the fourth node, and the other one is connected to the pixel electrode.

In a possible implementation, the gating sub-circuit comprises a second transistor and a third transistor;

a gate of the second transistor is connected to the second node, one of a source and a drain of the second transistor is connected to the display data signal of the to-be-displayed picture, and the other one is connected to the fourth node; and a gate of the third transistor is connected to the first node, one of a source and a drain of the third transistor is connected to the display data signal of the normally-black picture, and the other one is connected to the fourth node.

In a possible implementation, the first switching circuit and the control circuit are both connected to a first scanning line which provides the first scanning signal.

In a possible implementation, the first switching circuit comprises a fourth transistor;

a gate of the fourth transistor is connected to the first scanning signal, one of a source and a drain of the fourth transistor is connected to the second node, and the other one is connected to the third node;

wherein the active level of the first scanning signal is within a range of a gate voltage that causes the fourth transistor to operate in a cut-off region.

In a possible implementation, the control circuit comprises a fifth transistor;

a gate of the fifth transistor is connected to the first scanning signal, one of a source and a drain of the fifth transistor is connected to the level control signal, and the other one is connected to the first node;

wherein the active level of the first scanning signal is within a range of a gate voltage that causes the fifth transistor to operate beyond a cut-off region.

In a possible implementation, the first inverter circuit comprises a sixth transistor and a seventh transistor, and the second inverter circuit comprises an eighth transistor and a ninth transistor;

a gate of the sixth transistor is connected to the first node, one of a source and a drain of the sixth transistor is connected to the second node, and the other one is connected to a first level voltage line;

a gate of the seventh transistor is connected to the first node, one of a source and a drain of the seventh transistor is connected to a second level voltage line, and the other one is connected to the second node;

a gate of the eighth transistor is connected to the second node, one of a source and a drain of the eighth transistor is connected to the third node, and the other one is connected to the first level voltage line; and a gate of the ninth transistor is connected to the second node, one of a source and a drain of the ninth transistor is connected to the second level voltage line, and the other one is connected to the third node;

wherein a level on the first level voltage line is within a range of a gate voltage that causes the sixth transistor and the eighth transistor to operate in a cut-off region, a level on the second level voltage line is within a range of a gate voltage that causes the seventh transistor and the ninth transistor to operate in a cut-off region, and the level on the first level voltage line is opposite to the level on the second level voltage line.

DETAILED DESCRIPTION

To make the principles and advantages of the present disclosure clearer, the embodiments of the present disclosure will be described below in detail in conjunction with the accompanying drawings. It is obvious that the described embodiments are part rather than all of the embodiments of the present disclosure. All other embodiments derived by those of ordinary skill in the art based on the embodiments of the present disclosure without creative effort are within the protection scope of the present disclosure. Unless otherwise defined, technical terms or scientific terms used in the present disclosure shall be of ordinary meaning as understood by those of ordinary skill in the art to which the present disclosure pertains. The term "first" or "second" or a similar term used in the present disclosure does not denote any order, quantity, or importance, but is merely used to distinguish different components. The term "comprising" or a similar term means that elements or items which appear before the term include the elements or items listed after the term and their equivalents, and do not exclude other elements or items. The term "connection" or "connected to" or a similar term is not limited to a physical or mechanical connection but may include an electrical connection that is direct or indirect.

It can be noted that a traditional active-matrix display device, no matter in a dynamic-picture or static-picture display mode, writes data into a pixel through a driver. In this case, during display of a static picture, the driver repeatedly writes the same data into the pixel. In view of this, a memory may be disposed in each pixel, such that during display of the static picture, data memorized by the memories may be written into the pixels to replace of driving by the driver and reduce power loss. To meet the application demands of high-PPI (Pixels Per Inch), low-power-consumption and low-cost of the display device, a latch circuit formed by transistors is disposed within the pixel to realize the function of the memory. However, in practice, such a latch may easily cause an output signal abnormality during the reversing of an output level, leading to an unstable display state of a pixel circuit and other abnormities such as noise and a blurred screen, which seriously affects the performance of a display product.

Figure 1:
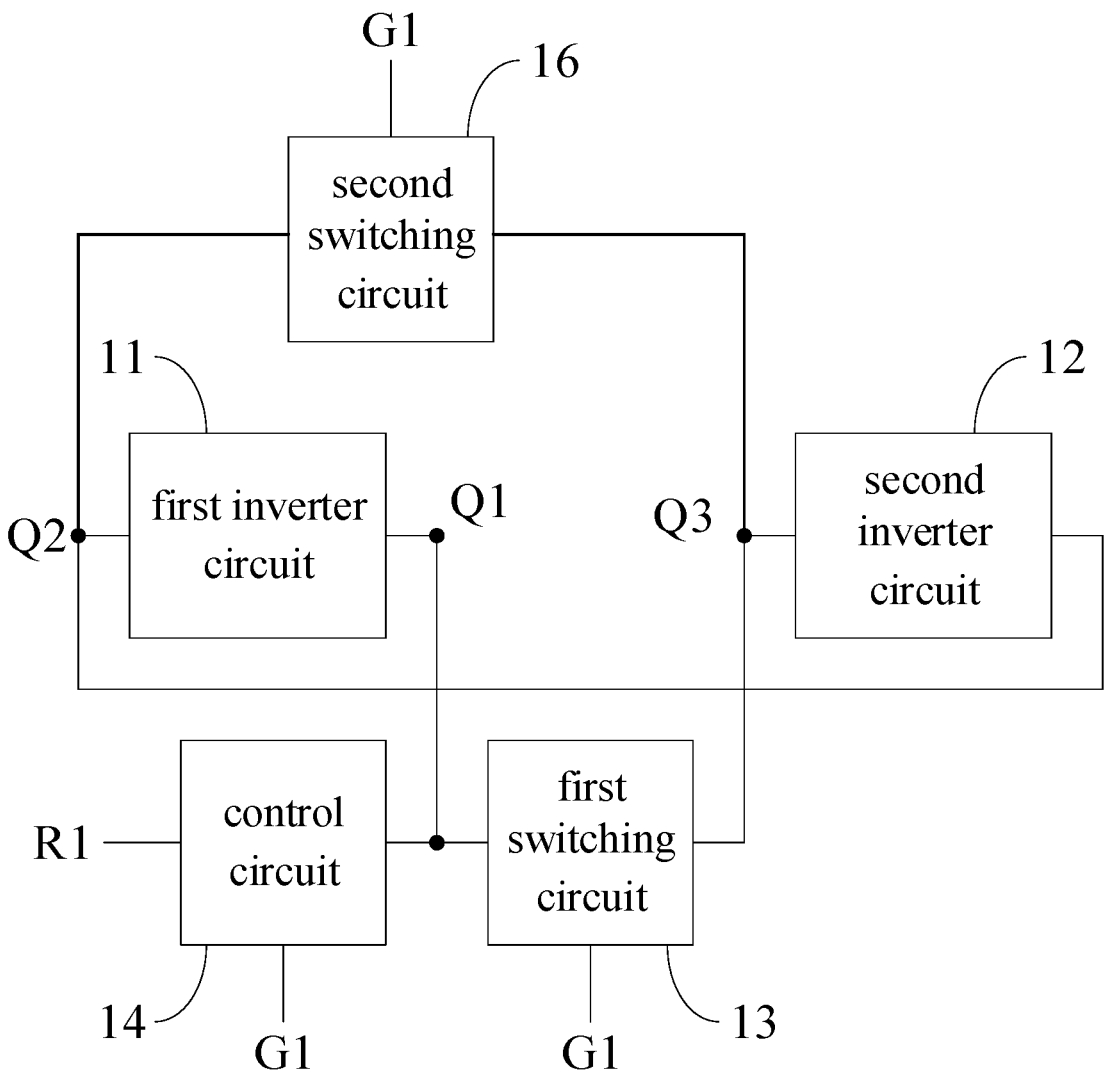
FIG. 1 is a block diagram of a structure of a pixel circuit according to an embodiment of the present disclosure.

FIG. 1 is a block diagram of a structure of a pixel circuit according to an embodiment of the present disclosure. Referring to FIG. 1, the pixel circuit includes a first inverter circuit 11, a second inverter circuit 12, a first switching circuit 13 and a control circuit 14. An input terminal of the first inverter circuit 11 is connected to a first node Q1 and an output terminal is connected to a second node Q2. An input terminal of the second inverter circuit 12 is connected to the second node Q2 and an output terminal is connected to a third node Q3. The first switching circuit 13 is connected respectively to the first node Q1 and the third node Q3 and configured to disconnect a connection between the first node Q1 and the third node Q3 when a first scanning signal G1 is at an active level. The control circuit 14 is connected to the first node Q1 and configured to control a level at the first node Q1 according to a level control signal R1 when the first scanning signal G1 is at an active level.

It should be noted that an active level and an inactive level herein refer to two different pre-configured voltage ranges (both based on a common terminal voltage) in terms of a specific circuit node respectively. In an example, active levels of all circuit nodes are high levels in a digital circuit. In another example, active levels of all circuit nodes are low levels in a digital circuit. In still another example, active levels at the first node Q1 and the third node Q3 are high levels, and an active level of the first scanning signal G1 is a low level. Of course, the setting of the active level and the inactive level may not be limited to the above-mentioned examples.

It should be understood that the first inverter circuit 11 and the second inverter circuit 12 are both a circuit structure that can invert the level at the output terminal from the level at the input terminal. For example, a low level is output at the output terminal when the input terminal is at a high level, and a high level is output at the output terminal when the input terminal is at a low level. It should be noted that the inverting function of the first inverter circuit 11 and/or the second inverter circuit 12 may be unidirectional (the level at the output terminal may not affect the level at the input terminal, for example, the input terminal may be kept at a high level when the output terminal is at a high level) or bidirectional (the level at the output terminal and the level at the input terminal may affect each other, for example, the input terminal may also be at a low level when the output terminal is at a high level). When the bidirectional inverting function is provided, the input terminal and the output terminal are symmetrical, and a circuit function thereof is kept unchanged when they are exchanged. Besides, the first inverter circuit 11 and/or the second inverter circuit 12 may be provided with an enable terminal that controls the inverting function to be effective or not. The input terminal and the output terminal may be, for example, in a high-impedance state or an open-circuit state when the inverting function is not effective.

It should be also understood that the first inverter circuit 11 and the second inverter circuit 12 in an operating state may form a latch structure when the first node Q1 and the third node Q3 are electrically connected to each other. That is, before the level of the first node Q1 or the level of the second node Q2 is changed by an external signal, the first node Q1 and the second node Q2 can stably maintain the levels inverted from each other. The levels of the first node Q1 and the second node Q2 are kept in the latch structure as stored data and may be used for controlling or triggering related operations.

In an exemplary implementation of the embodiments of the present disclosure, the control circuit 14 reverses the low level at the first node Q1 into the high level when the first scanning signal G1 is at an active level and the level control signal R1 is at the high level, such that the second node Q2 may be set to be at the low level under the action of the first inverter circuit 11, and the third node Q3 may be set to be at the high level under the action of the second inverter circuit 12. During this period, the first switching circuit 13 disconnects a connection between the first node Q1 and the third node Q3, thereby completing the reversing of the latch level.

In a comparative example, the first node Q1 and the third node Q3 are always electrically connected. In a process of pulling-up a potential at the first node Q1 to a high level (the level at the first node Q1 is shifted into a high level) by the control circuit 14, the potentials at the third node Q3 and the first node Q1 may be pulled-down under the inverting function of the second inverter circuit 12. At this time, the pull-up function of the control circuit 14 may compete with the pull-down function of the second inverter circuit 12. For example, when the control circuit 14 provides a level shifting current that flows to the first node Q1, the second inverter circuit 12 may provide a competition current that flows from the first node Q1 to the low level. Although the pull-up function of the control circuit 14 may gain a competitive advantage by setting device parameters (for example, the level shifting current is higher than the competition current), a failure of level switching of the control circuit 14 is easily caused due to the level switching limited time, the device loss, or the device characteristic drift, etc., which is manifested as an abnormal output (the latch level cannot be flipped normally) of the latch structure, and the operations controlled or triggered by its output may be disordered, resulting in noise, dead pixels, a blurred screen and other abnormities.

In the embodiments of the present disclosure, it can be seen from comparison that the first switching circuit 13 may disconnect a connection between the first inverter circuit 11 and the second inverter circuit 12 when the control circuit 14 shifts the level of the first node Q1, such that the control circuit 14 and the second inverter circuit 12 may not compete with each other when the level of the first node Q1 is shifted, thereby avoiding a consequent signal abnormity, enhancing the working stability of the pixel circuit, and contributing to improving the performance of the display product.

It should be understood that a control object of the control circuit 14 may not be limited to the first node Q1, and a control mode may not be limited to level shifting of a single node, it may also be that, for example, the second node Q2 is pulled-down while the first node Q1 is pulled-up, which is not limited thereto. In an example, the control circuit 14 is both connected to the first node and the second node, and is configured to control the levels at the first node and the second node in accordance with the level control signal when the first scanning signal is at an active level. It may also be understood that there are not limited in the embodiments of the present disclosure that how is the latch applied for the functional implementation of the pixel circuit, as well as the type of the applied pixel circuit. The working stability of any pixel circuit including the latch structure may be improved in the manner of the embodiments of the present disclosure. Thus, the display performance is improved.

Figure 2:
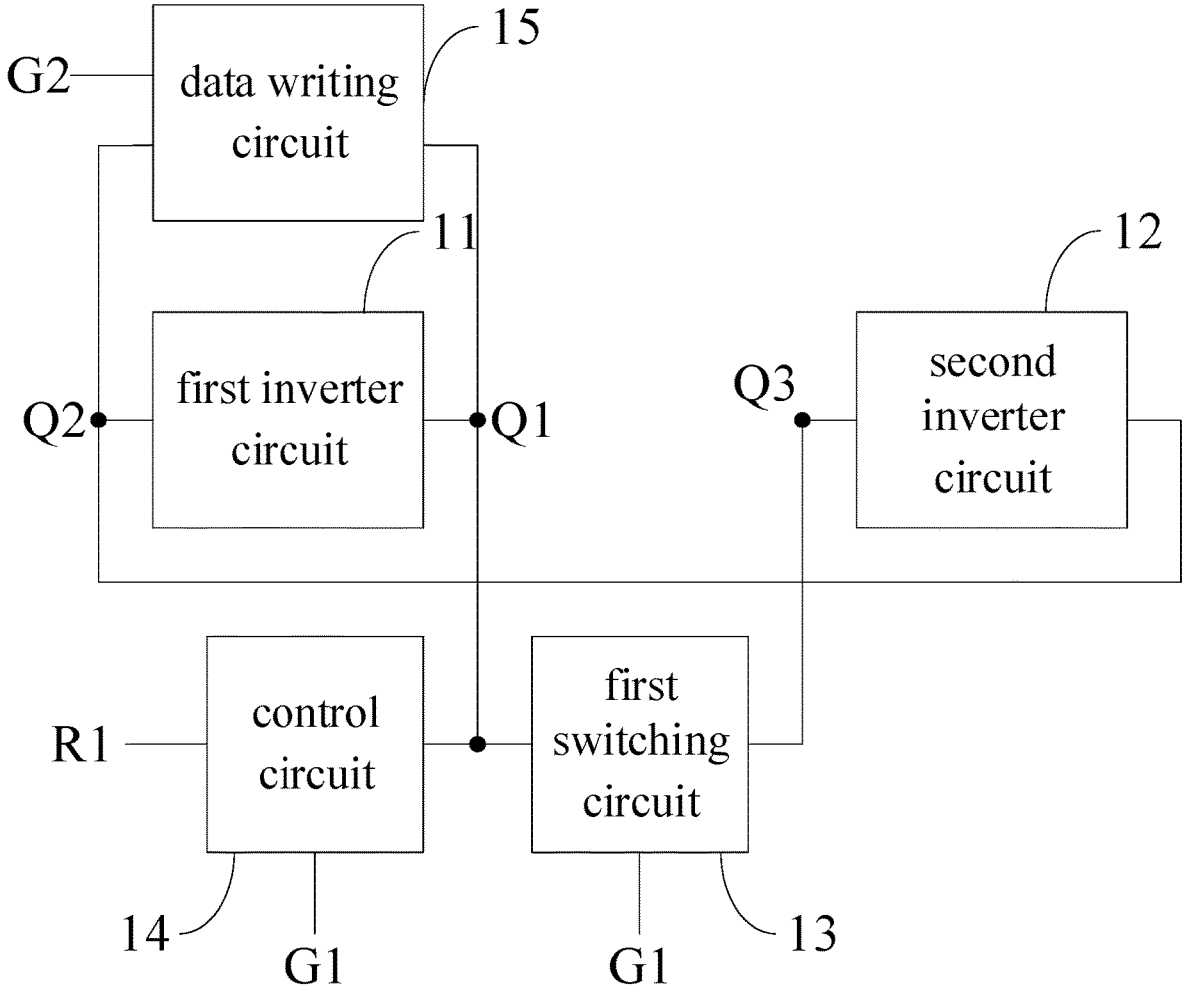
FIG. 2 is a block diagram of a structure of a pixel circuit according to another embodiment of the present disclosure.

FIG. 2 is a block diagram of a structure of a pixel circuit provided by another embodiment of the present disclosure. Referring to FIG. 2, the pixel circuit according to the embodiments of the present disclosure further comprises a data writing circuit 15, in addition to a first inverter circuit 11, a second inverter circuit 12, a first switching circuit 13 and a control circuit 14. The data writing circuit 15 is configured to determine a data writing mode in accordance with the levels at the first node Q1 and/or the second node Q2 and to write a display data signal in accordance with the currently determined data writing mode when a second scanning signal G2 is at the active level. In an example, the different data writing modes may be different in at least one aspect of the picture type of the written display data signal, the format of the written display data signal, the duration of writing the display data signal and the time period of writing the display data signal. In the embodiments of the present disclosure, the latch level stored in the latch structure is configured for controlling the data writing mode of the pixel circuit. That is, the writing of the display data signals can be simultaneously performed in different data writing modes between different pixel circuits, thereby realizing the operations such as sub-regional display or display region clipping.

Figure 3:
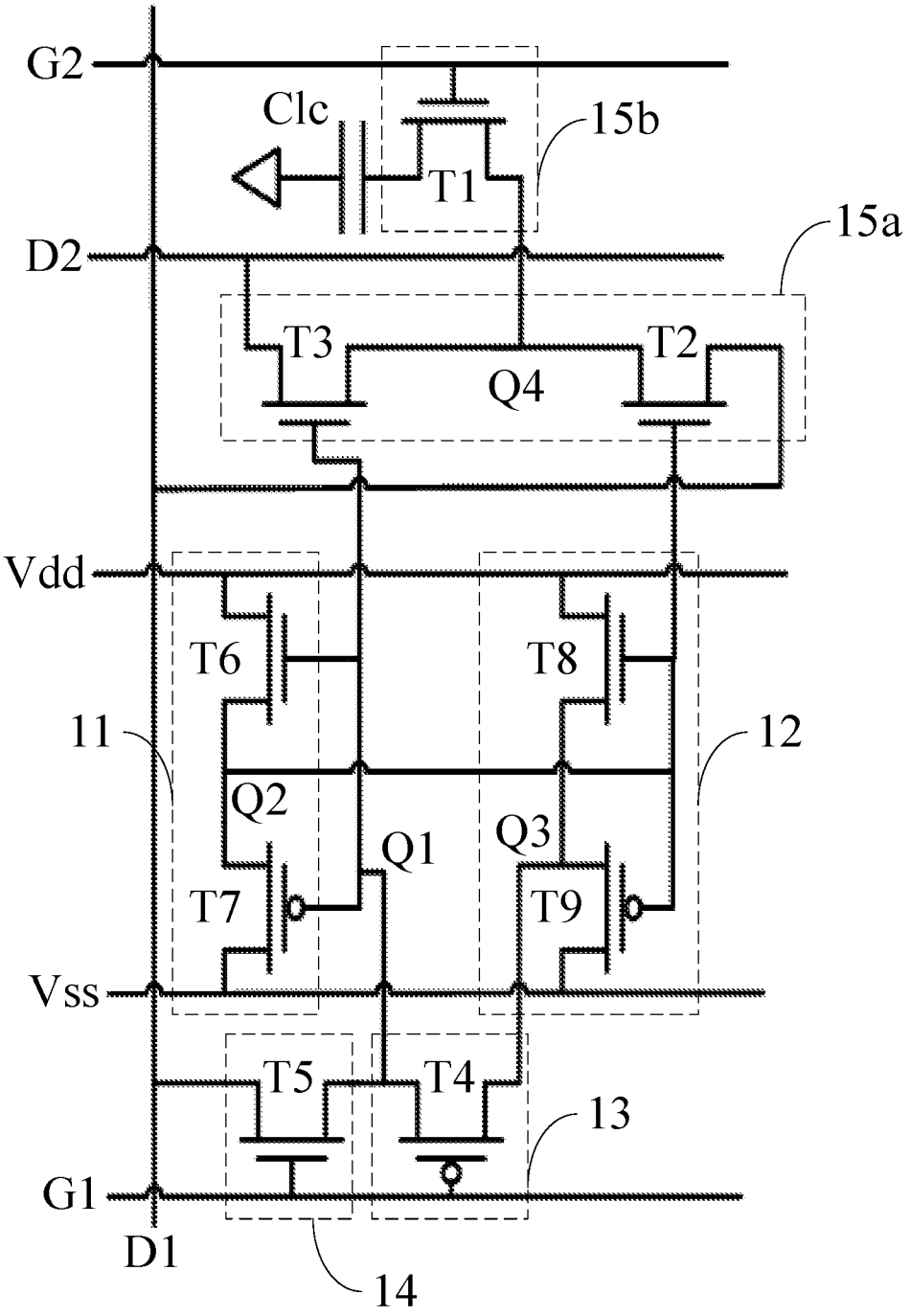
FIG. 3 is a schematic diagram of a circuit structure of a pixel circuit according to an embodiment of the present disclosure.

FIG. 3 is a schematic diagram of a circuit structure of a pixel circuit provided by an embodiment of the present disclosure. Referring to FIG. 3, the pixel circuit according to the embodiment of the present disclosure comprises a first inverter circuit 11, a second inverter circuit 12, a first switching circuit 13 and a control circuit 14, and further comprises a data writing circuit. In FIG. 3, the data writing circuit comprises a gating sub-circuit 15*a* and a scanning sub-circuit 15*b*.

The scanning sub-circuit 15*b* comprises a first transistor T1. A gate of the first transistor T1 is connected to a second scanning signal G2. One of a source and a drain of the first transistor T1 is connected to a fourth node P4, and the other one is connected to a pixel electrode. It should be noted that connection relationship between the source and the drain of the first transistor may be set in accordance with different specific types of the transistors, so as to match the direction of current that flows through the transistor. When the transistor adopts a structure that the source and the drain are symmetrical, the source and the drain may be regarded as two electrodes that are not specially distinguished. It also needs to be noted that FIG. 3 illustrates a liquid crystal capacitor Clc that corresponds to the pixel circuit. As a pole of the liquid crystal capacitor Clc, the above mentioned pixel electrode may control the deflection of liquid crystal molecules through an electric field formed between the pixel electrode and the other pole, and then control a gray scale of a pixel. In another example, the first transistor T1 may be an N-type thin film transistor (TFT). Thus, the active level of the second scanning signal G2 may be set to be at a high level that enables the first transistor T1 to be turned on. Accordingly, the scanning sub-circuit 15*b* may provide the display data signal at the fourth node P4 for the pixel electrode when the second scanning signal G2 is at an active level.

In FIG. 3, the gating sub-circuit 15*a* comprises a second transistor T2 and the third transistor T3. Herein, a gate of the second transistor T2 is connected to the second node Q2. One of a source and a drain of the second transistor T2 is connected to a display data signal D1 of a to-be-displayed picture, and the other one is connected to a fourth node Q4. A gate of the third transistor T3 is connected to the first node Q1. One of a source and a drain of the third transistor T3 is connected to a display data signal D2 of a normally-black picture, and the other one is connected to the fourth node Q4. In an example, the second transistor T2 and the third transistor T3 may be N-type thin film transistors. Thus, the active levels at the first node Q1 and the second node Q2 are both high levels, such that the gating sub-circuit 15*a* may provide one of the display data signal D1 of the to-be-displayed picture and the display data signal D2 of the normally-black picture for the fourth node Q4 in accordance with the levels at the first node Q1 and the second node Q2.

It should be understood that the gating sub-circuit 15*a* may determine whether the fourth node Q4 is connected to the display data signal D1 of the to-be-displayed picture or the display data signal D2 of the normally-black picture in accordance with which one of the first node Q1 and the second node Q2 is at the high level. The scanning sub-circuit 15*b* may provide the display data signal at the fourth node P4 for the pixel electrode when the active level of the second scanning signal G2 arrives. Thus, the data writing mode of the pixel may be controlled by the stable latch level. An MIP (Memory In Pixel) pixel structure having a latch structure therein can be realized.

It should be also understood that a combination of the display data signal D1 of the to-be-displayed picture and the display data signal D2 of the normally-black picture may realize the selection of the data writing mode between the normally-black picture and the to-be-displayed picture. In other implementations, selection of the data writing mode between other pictures may also be realized by other combinations. For example, the black and white display between a normally-black picture and a normally-white picture can be realized through a combination of a display data signal of the normally-white picture and a display data signal of the normally-black picture. Alternatively, the selection of the data writing mode between the normally-white picture and the to-be-displayed picture can be realized by a combination of the display data signal of the normally-white picture and the display data signal of the to-be-displayed picture, and the like. In an example, the display data signal D1 and the display data signal D2 are respectively a signal that is consistent with a common voltage signal and a signal that is inverted from the common voltage signal. In another example, the display data signal D1 and the display data signal D2 are respectively a signal that is consistent with the common voltage signal and a display data signal of a color to-be-displayed picture, so as to realize the color display with a maximum display color number of 8, 262 K and even 16.7 M. Moreover, the data writing circuit may not only utilize the first node and the second node to control the selection of the data writing mode, but also utilize the first node or the second node for replacement. For example, the second transistor T2 may be replaced by a P-type transistor, and a gate thereof is changed to be connected to the first node Q1, or, the first transistor T1 is replaced by the P-type transistor, and a gate thereof is changed to be connected to the second node Q2, such that the functions of the gating sub-circuit 15*a* and the data writing circuit are kept unchanged. Of course, the optional data writing mode may not be limited to the above forms. The ways in which the data writing circuit utilizes the first node and/or the second node to determine the data writing mode may also not be limited to the above-mentioned ways.

In FIG. 3, the first switching circuit 13 comprises a fourth transistor T4. A gate of the fourth transistor T4 is connected to the first scanning signal G1. One of a source and a drain of the fourth transistor T4 is connected to the second node Q2, and the other one is connected to the third node Q3. Herein, the active level of the first scanning signal G1 is within a range of a gate voltage that causes the fourth transistor T4 to operate in a cut-off region. For example, the active level of the first scanning signal G1 may be the high level while the fourth transistor T4 is the P-type transistor. Thus, the first switching circuit 13 may disconnect a connection between the first node Q1 from the third node Q3 when the first scanning signal G1 is at the active level.

In FIG. 3, the control circuit 14 comprises a fifth transistor T5. A gate of the fifth transistor T5 is connected to the first scanning signal G1. One of a source and a drain of the fifth transistor T5 is connected to the display data signal D1 of a to-be-displayed picture, which serves as a control signal, and the other one is connected to the first node Q1. Herein, the active level of the first scanning signal G1 is within a range of a gate voltage that causes the fifth transistor T5 to operate beyond a cut-off region (such as a linear region and a saturation region). For example, the active level of the first scanning signal G1 may be a high level while the fifth transistor T5 may be the N-type thin film transistor. Thus, when the first scanning signal G1 is at the active level, the control circuit 14 may control the level at the first node Q1 in accordance with the display data signal D1 that serves as the level control signal.

It should be understood that the control circuit and the data writing circuit are both connected to the data line (for providing the display data signal D1), and both of the level control signal and the display data signal are provided by the data line, such that the level control signal and the display data signal may share the same line, which contributes to reducing the number of signal lines in a display region, simplifies the layout of traces in the display region, and increases the PPI. It also should be understood that the first switching circuit and the control circuit are both connected to a first scanning line G1 (for providing the first scanning signal), and the design between the fourth transistor T4 and the fifth transistor T5, for example, can be utilized to avoid using more than one signal line, which contributes to reducing the number of the signal lines in the display region, simplifying the layout of traces in the display region and increasing the PPI.

n FIG. 3, the first inverter circuit 11 includes a sixth transistor T6 and a seventh transistor T7, and the second inverter circuit 12 includes an eighth transistor T8 and a ninth transistor T9. Herein, the gate of the sixth transistor T6 is connected to the first node Q1, one of the source and the drain is connected to the second node Q2, and the other one is connected to the first level voltage line Vdd; the gate of the seventh transistor T7 is connected to the first node Q1, one of the source and the drain is connected to the second level voltage line Vss, and the other one is connected to the second node Q2; the gate of the eighth transistor T8 is connected to the second node Q2, and one of the source and the drain is connected the third node Q3, and the other one is connected to the first level voltage line Vdd; the gate of the ninth transistor T9 is connected to the second node Q2, and one of the source and the drain is connected to the second level voltage line Vss, and the other one is connected to the third node Q3. The level on the first level voltage line Vdd is within a range of a gate voltage that causes the sixth transistor T6 and the eighth transistor T8 to operate in a cut-off region, and the level on the second level voltage line Vss is within a range of a gate voltage that causes the seventh transistor T7 and the ninth transistor T9 to operate in a cut-off region. The level on the first level voltage line Vdd is opposite to the level on the second level voltage line Vss (refer to one of the high level and low level respectively). In an example, the first level voltage line Vdd is a high-level voltage line. The second level voltage line Vss is a low-level voltage line. The sixth transistor T6 and the eighth transistor T8 are N-type thin film transistors. The seventh transistor T7 and the ninth transistor T9 are P-type thin film transistors. Thus, the first inverter circuit 11 may set a level at the second node Q2 as a low level when the first node Q1 is a high level, and set a level at the second node Q2 as a high level when the first node Q1 is a low level, so as to realize a unidirectional inverting function. The second inverter circuit 12 may set a level at the third node Q3 as a low level when the second node Q2 is a high level and set a level at the third node Q3 as a high level when the second node Q2 is a low level, so as to realize the unidirectional inverting function.

It can be seen that the first inverter circuit 11 and the second inverter circuit 12 in an operating state may form the latch structure when the first node Q1 and the third node Q3 are electrically connected to each other. That is, before the level of the first node Q1 or the second node Q2 is changed by an external signal, the first node Q1 and the second node Q2 can stably maintain the levels inverted from each other. However, as the switching circuit 13 may disconnect a connection between the first inverter circuit 11 and the second inverter circuit 12 when the control circuit 14 shifts the level of the first node Q1, the control circuit 14 and the second inverter circuit 12 may not compete with each other in a level shifting process of the first node Q1. Thus, in the embodiments of the present disclosure, a consequent signal abnormity can be avoided, the working stability of the pixel circuit can be enhanced, and the performance of the display product can be improved.

It should be understood that the implementation illustrated by FIG. 3 is merely exemplary and may be modified as required in specific application scenarios without departing from the technical concept of the embodiments of the present disclosure. For example, refer to FIG. 1, for the technical solution of the two inverter circuits both having the bidirectional inverting functions, the pixel circuit may further comprise a second switching circuit 16 that separates the second node Q2 from the third node Q3. The second switching circuit 16 is configured to disconnect the electrical connection between the second node Q2 and the third node Q3 when the first scanning signal G1 is at the active level. The control circuit 14 may be connected respectively to the first node Q1 and the second node Q2 and is configured to control the levels at the first node Q1 and the second node Q2 in accordance with the level control signal when the first scanning signal G1 is at the active level. Based on this, the connection between the two inverter circuits may be completely cut off during the period in which the first scanning signal G1 is at the active level, such that competition can be avoided and the working stability of the pixel circuit can be improved.

Figure 4:
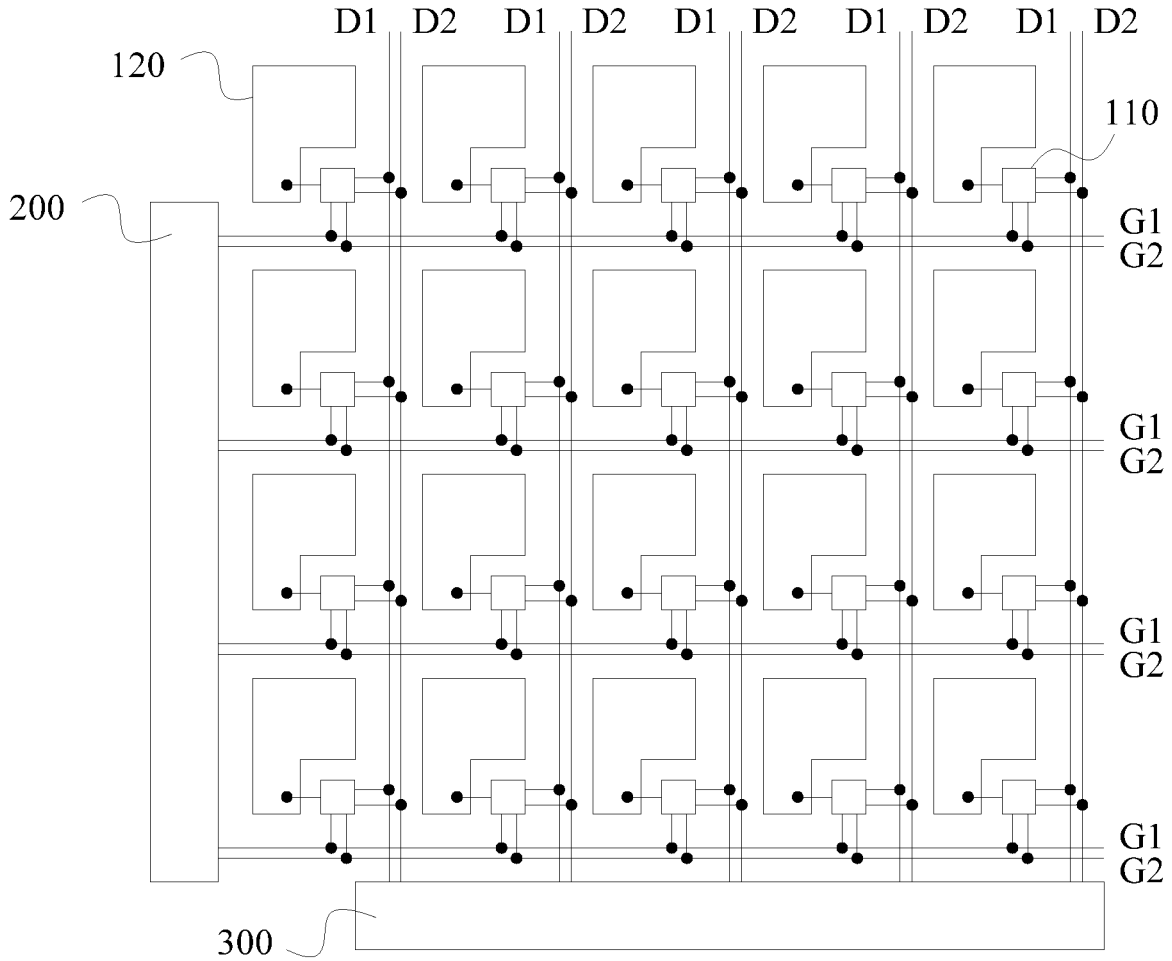
FIG. 4 is a schematic diagram of a setting mode of a pixel circuit in a display device according to an embodiment of the present disclosure.

FIG. 4 is a schematic diagram of a setting mode of a pixel circuit in a display device in an embodiment of the present disclosure. Referring to FIG. 4, the display device comprises a gate driver 200 and a source driver 300, and further comprises pixel circuits 110 and pixel electrodes 120, which are respectively disposed in each sub-pixel region of a display region. Herein, the pixel circuit 110 may be any of the above-mentioned pixel circuits. In an example, the display device comprises a first substrate and a second substrate. The gate driver 200, the pixel electrode 120 and the pixel circuit 110 are disposed on the first substrate of the display device. The source driver is disposed on a circuit board electrically connected to the first substrate. The first substrate further comprises a plurality of first scanning lines, a plurality of second scanning lines, a plurality of first data lines and a plurality of second data lines. Each of the plurality of first scanning lines and the plurality of second scanning lines is connected to an output terminal of the gate driver 200. All pixel circuits 110 in each pixel row are connected to a first scanning line and a second scanning line, such that the gate driver 200 may provide the first scanning signal G1 and the second scanning signal G2 for each pixel row. Each of the plurality of first data lines and the plurality of second data lines is connected respectively to an output terminal of the source driver 300. All the pixel circuits 110 in each pixel column are connected to a first data line and a second data line, such that the source driver 300 may provide the first display data signal D1 and the second display data signal D2 for each pixel column. In each sub-pixel region, the pixel circuit 110 and the pixel electrode 120 are electrically connected to each other. Thus, liquid crystal display may be realized based on any one of the pixel circuits.

Figure 5:
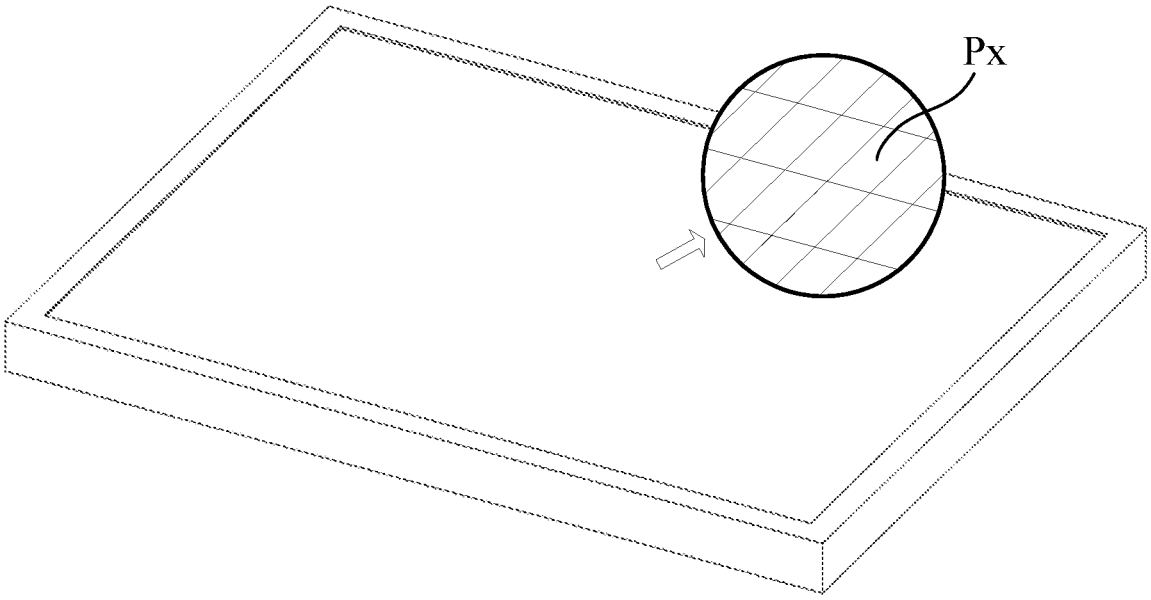
FIG. 5 is a schematic diagram of an arrangement of sub-pixel regions of a display device according to an embodiment of the present disclosure.

Based on the same inventive concept, an embodiment of the present disclosure provides a display device which comprises any one of the above mentioned pixel circuits. The display device in the embodiments of the present disclosure may be a display panel, a mobile phone, a tablet computer, a television, a display, a laptop, a digital photo frame, a navigator or any other products or parts that have a display functions. As an example, FIG. 5 is a schematic diagram of a structure of a display device provided by an embodiment of the present disclosure. The display device comprises an array substrate that can be any one of the first substrates as mentioned above, a color film substrate opposite to the array substrate, and a liquid crystal layer formed between the array substrate and the color film substrate through a cell-forming process. Referring to FIG. 5, the display device comprises sub-pixel regions Px that are disposed in rows and columns in a display region. Each sub-pixel region Px has a pixel circuit. An electric field for controlling the deflection of liquid crystals may be produced between a pixel electrode and a common electrode of each sub-pixel region Px. Display gray scales of the sub-pixel regions Px can be adjusted through the cooperated electric signals on the first scanning line, the second scanning line, the first data line and the second data line.

The foregoing descriptions are only exemplary embodiments of the present disclosure, and are not intended to limit the present disclosure. Within the spirit and principles of the disclosure, any modifications, equivalent substitutions, improvements, etc., are within the protection scope of the appended claims of the present disclosure.

What is claimed is:

1. A pixel circuit, comprising:

a first inverter circuit having an input terminal connected to a first node and an output terminal connected to a second node;

a second inverter circuit having an input terminal connected to the second node and an output terminal connected to a third node;

a first switching circuit connected respectively to the first node and the third node, and configured to disconnect a connection between the first node and the third node when a first scanning signal is at an active level;

a second switching circuit connected respectively to the second note and the third node, and configured to disconnect a connection between the second node and the third node when the first scanning signal is at the active level; and a control circuit connected to at least one of the first node and the second node, and configured to control a level of at least one of the first node and the second node according to a level control signal when the first scanning signal is at the active level.

2. The pixel circuit according to claim 1, further comprising:

a data writing circuit, connected to at least one of the first node and the second node, and configured to determine a data writing mode according to the level of at least one of the first node and the second node and to write a display data signal according to a currently determined data writing mode when a second scanning signal is at an active level.

3. The pixel circuit according to claim 2, wherein the control circuit and the data writing circuit are both connected to a data line, and the level control signal and the display data signal are provided by the data line.

4. The pixel circuit according to claim 2, wherein the data writing circuit comprises:

a gating sub-circuit connected to at least one of the first node and the second node and configured to provide a display data signal of one of a to-be-displayed picture and a normally-black picture for a fourth node according to the level of at least one of the first node and the second node; and a scanning sub-circuit connected to the fourth node and configured to provide the display data signal at the fourth node for a pixel electrode when the second scanning signal is at an active level.

5. The pixel circuit according to claim 4, wherein the scanning sub-circuit comprises a first transistor, a gate of the first transistor is connected to the second scanning signal, one of a source and a drain of the first transistor is connected to the fourth node, and the other is connected to the pixel electrode.

6. The pixel circuit according to claim 4, wherein the gating sub-circuit comprises a second transistor and a third transistor;

a gate of the second transistor is connected to the second node, one of a source and a drain of the second transistor is connected to the display data signal of the to-be-displayed picture, and the other is connected to the fourth node; and a gate of the third transistor is connected to the first node, one of a source and a drain of the third transistor is connected to the display data signal of the normally-black picture, and the other is connected to the fourth node.

7. The pixel circuit according to claim 1, wherein the first switching circuit and the control circuit are both connected to a first scanning line which provides the first scanning signal.

8. The pixel circuit according to claim 1, wherein the first switching circuit comprises a fourth transistor;

a gate of the fourth transistor is connected to the first scanning signal, one of a source and a drain of the fourth transistor is connected to the first node, and the other is connected to the third node;

wherein the active level of the first scanning signal is within a range of a gate voltage that causes the fourth transistor to operate in a cut-off region.

9. The pixel circuit according to claim 1, wherein the control circuit comprises a fifth transistor;

a gate of the fifth transistor is connected to the first scanning signal, one of a source and a drain of the fifth transistor is connected to the level control signal, and the other is connected to the first node;

wherein the active level of the first scanning signal is within a range of a gate voltage that causes the fifth transistor to operate beyond a cut-off region.

10. The pixel device according to claim 1, wherein the first inverter circuit comprises a sixth transistor and a seventh transistor, and the second inverter circuit comprises an eighth transistor and a ninth transistor;

a gate of the sixth transistor is connected to the first node, one of a source and a drain of the sixth transistor is connected to the second node, and the other is connected to a first level voltage line;

a gate of the seventh transistor is connected to the first node, one of a source and a drain of the seventh transistor is connected to a second level voltage line, and the other is connected to the second node;

a gate of the eighth transistor is connected to the second node, one of a source and a drain of the eighth transistor is connected to the third node, and the other is connected to the first level voltage line; and a gate of the ninth transistor is connected to the second node, one of a source and a drain of the ninth transistor is connected to the second level voltage line, and the other is connected to the third node;

wherein a level on the first level voltage line is within a range of a gate voltage that causes the sixth transistor and the eighth transistor to operate in a cut-off region, a level on the second level voltage line is within a range of a gate voltage that causes the seventh transistor and the ninth transistor to operate in a cut-off region, and the level on the first level voltage line is opposite to the level on the second level voltage line.

11. A display device, comprising a plurality of pixel circuits, wherein each pixel circuit comprises:

a first inverter circuit having an input terminal connected to a first node and an output terminal connected to a second node;

a second inverter circuit having an input terminal connected to the second node and an output terminal connected to a third node;

a first switching circuit connected respectively to the first node and the third node and configured to disconnect a connection between the first node and the third node when a first scanning signal is at an active level;

a second switching circuit connected respectively to the second node and the third node, and configured to disconnect a connection between the second node and the third node when the first scanning signal is at the active level; and a control circuit connected to at least one of the first node and the second node and configured to control a level of at least one of the first node and the second node according to a level control signal when the first scanning signal is at the active level.

12. The display device according to claim 11, wherein the pixel circuit further comprises:

a data writing circuit connected to at least one of the first node and the second node and configured to determine a data writing mode according to the level of at least one of the first node and the second node and to write a display data signal according to a currently determined data writing mode when a second scanning signal is at an active level.

13. The display device according to claim 12, wherein the control circuit and the data writing circuit are both connected to a data line, and the level control signal and the display data signal are provided by the data line.

14. The display device according to claim 12, wherein the data writing circuit comprises:

a gating sub-circuit connected to at least one of the first node and the second node and configured to provide a display data signal of one of a to-be-displayed picture and a normally-black picture for a fourth node according to the level of at least one of the first node and the second node; and a scanning sub-circuit connected to the fourth node and configured to provide the display data signal at the fourth node for a pixel electrode when the second scanning signal is at an active level.

15. The display device according to claim 14, wherein the scanning sub-circuit comprises a first transistor, a gate of the first transistor is connected to the second scanning signal, one of a source and a drain of the first transistor is connected to the fourth node, and the other is connected to the pixel electrode.

16. The display device according to claim 14, wherein the gating sub-circuit comprises a second transistor and a third transistor;

a gate of the second transistor is connected to the second node, one of a source and a drain of the second transistor is connected to the display data signal of the to-be-displayed picture, and the other is connected to the fourth node; and a gate of the third transistor is connected to the first node, one of a source and a drain of the third transistor is connected to the display data signal of the normally-black picture, and the other is connected to the fourth node.

17. The display device according to claim 11, wherein the first switching circuit and the control circuit are both connected to a first scanning line which provides the first scanning signal.

18. The display device according to claim 11, wherein the first switching circuit comprises a fourth transistor;

a gate of the fourth transistor is connected to the first scanning signal, one of a source and a drain of the fourth transistor is connected to the first node, and the other is connected to the third node;

wherein the active level of the first scanning signal is within a range of a gate voltage that causes the fourth transistor to operate in a cut-off region.

19. The display device according to claim 11, wherein the control circuit comprises a fifth transistor;

a gate of the fifth transistor is connected to the first scanning signal, one of a source and a drain of the fifth transistor is connected to the level control signal, and the other is connected to the first node;

wherein the active level of the first scanning signal is within a range of a gate voltage that causes the fifth transistor to operate beyond a cut-off region.

20. The display device according to claim 11, wherein the first inverter circuit comprises a sixth transistor and a seventh transistor, and the second inverter circuit comprises an eighth transistor and a ninth transistor;

a gate of the sixth transistor is connected to the first node, one of a source and a drain of the sixth transistor is connected to the second node, and the other is connected to a first level voltage line;

a gate of the seventh transistor is connected to the first node, one of a source and a drain of the seventh transistor is connected to a second level voltage line, and the other is connected to the second node;

a gate of the eighth transistor is connected to the second node, one of a source and a drain of the eighth transistor is connected to the third node, and the other is connected to the first level voltage line; and a gate of the ninth transistor is connected to the second node, one of a source and a drain of the ninth transistor is connected to the second level voltage line, and the other is connected to the third node;

wherein a level on the first level voltage line is within a range of a gate voltage that causes the sixth transistor and the eighth transistor to operate in a cut-off region, a level on the second level voltage line is within a range of a gate voltage that causes the seventh transistor and the ninth transistor to operate in a cut-off region, and the level on the first level voltage line is opposite to the level on the second level voltage line.

* * * * *